US008308249B2

(12) United States Patent
Matus, Jr.

(10) Patent No.: US 8,308,249 B2
(45) Date of Patent: Nov. 13, 2012

(54) CONVERTIBLE FOOD GUARD SYSTEM WITH ADJUSTABLE SIDE PANELS

(75) Inventor: Jose Orlando Matus, Jr., Gainesville, GA (US)

(73) Assignee: Elemental Ideas, LLC, Gainesville, GA (US)

( * ) Notice: Subject to any disclaimer, the term of this patent is extended or adjusted under 35 U.S.C. 154(b) by 404 days.

(21) Appl. No.: 12/572,379

(22) Filed: Oct. 2, 2009

(65) Prior Publication Data

US 2011/0080075 A1 Apr. 7, 2011

(51) Int. Cl.
*A47B 96/06* (2006.01)
*A47F 3/12* (2006.01)

(52) U.S. Cl. ..... 312/140.4; 312/137

(58) Field of Classification Search ..... 312/137, 312/140.3, 140.4, 114, 140, 271, 272, 273, 312/310; 248/288.11, 291.1; 84/421, 422
See application file for complete search history.

(56) References Cited

U.S. PATENT DOCUMENTS 245,486 A * 8/1881 Hafgar ..... 312/273
907,533 A * 12/1908 Schram et al. ..... 312/273
2,791,348 A * 5/1957 Adams ..... 220/812
3,847,250 A * 11/1974 Sherrill ..... 186/44
4,892,366 A * 1/1990 Yerman ..... 312/140.4
5,082,334 A * 1/1992 Beyer et al. ..... 312/140.4
D540,354 S * 4/2007 Rousselin ..... D15/81
2002/0014162 A1* 2/2002 Huegerich ..... 99/427
2005/0126858 A1* 6/2005 Yingst et al. ..... 186/38
2007/0236112 A1* 10/2007 Williman ..... 312/140.4
2008/0000398 A1* 1/2008 Barkley ..... 108/90

* cited by examiner

*Primary Examiner* — James O Hansen
*Assistant Examiner* — Sasha T Varghese

(57) ABSTRACT

A convertible food guard system with adjustable side panels, as well as features and aspects thereof, provides for the alignment of the leading edge of a side panel with the leading edge of a main viewing panel regardless of whether the convertible food guard system is in a cafeteria mode or a buffet mode. Exemplary embodiments of a convertible food guard system with adjustable side panels comprise, generally, positionable or translatable side panel components. More particularly, exemplary embodiments employ sliding adjustable side panel systems that may be comprised of a single side panel component or a plurality of side panel components. Advantageously, the use of adjustable side panels with a convertible food guard system enables the side panels to align with the leading edge of the main viewing panel when the system is in a buffet mode and retract out of the consumer's way when the system is in a cafeteria mode.

14 Claims, 11 Drawing Sheets

Fig. 6A-C

CONVERTIBLE FOOD GUARD SYSTEM WITH ADJUSTABLE SIDE PANELS

BACKGROUND

Food guard systems, sometimes referred to as "sneeze guards," are required by federal law for any cafeteria-style or self-service-style food establishment. Food guard systems are required to have a front glass panel, often referred to as a main viewing panel, that provides a barrier between the consumer and food that may be either directly accessed by the consumer, i.e. self service, or served to the consumer by an attendant, such as in a cafeteria. Therefore, in general, there are two types of food guard systems, namely, a self-service type of food guard system designed to allow consumers to serve themselves (buffet) and an attendant type of food guard system designed to allow an attendant to serve consumers (cafeteria). With food guard systems of the self-service type, an opening exists between the lower edge of the main viewing panel and the countertop to allow consumers to access food through the opening. With food guard systems of the attendant type, the main viewing panel extends over most or all of the vertical distance between the top panel of the food guard system and the countertop to eliminate the aforementioned opening. In other words, in an attendant-type food guard system, the main viewing panel separates the consumers from the food and an attendant who is located on the opposite side of the food guard system from the consumer serves the consumer.

FIG. 1 is a perspective view of a typical cafeteria style, or attendant-serve, food guard system known in the art. In the exemplary embodiment of a typical cafeteria style food guard system 100, a series of fixed panels, including a top panel 105, at least one side panel 110, and a main viewing panel 115 are fixed to a support structure 120. The panels operate to define an open backed space over a food service counter, or some other surface, such that consumers may view the food through the panels without having direct access to the same. The main viewing panel 115 in a typical embodiment of a cafeteria style food guard system, such as that depicted in FIG. 1, operates to define a plane that is substantially vertical and perpendicular to the food service counter. Further, the leading edge 115LE of the main viewing panel 115 is positioned such that the gap between the leading edge 115LE and the food service counter is minimized, thereby prohibiting consumer access to any food residing behind and under the system. Notably, when using a cafeteria style food guard system 100, food is accessed by an attendant through the open back of the space defined by the panels. The food is ultimately served by the attendant to the consumer by passing the food over the top panel 105 or around side panel 110.

FIG. 2 is a perspective view of a typical buffet style, or self-service, food guard system known in the art. In the exemplary embodiment of a typical buffet style food guard system 200, the main viewing panel 115 and top panel 105 previously described relative to a cafeteria style system 100 is effectively combined, function-wise, into a single main viewing panel 215. The main viewing panel 215 is shown in the exemplary embodiment as being fixed to a support structure 220 along with at least one side panel 210. Similar to the cafeteria style system 100, a typical buffet style system 200 operates to define an open backed space over a food service counter. Notably, the buffet style system 200 provides some protection to the food from airborne contaminants, as does the cafeteria style system 100, but the leading edge 215LE of the main viewing panel 215 is positioned well above the food service counter. Advantageously, when using a buffet style system 200, no attendant is required as consumers may directly access, i.e. self-serve, the food by reaching under the main viewing panel 215.

It should be noted that both the cafeteria style system 100 and the buffet style system 200 shown in FIGS. 1 and 2 operate to place the leading edge 210LE of a side panel component in substantial alignment, or at least juxtaposed, with the leading edge 215LE or general plane defined by the main viewing panel 115, 215.

Moreover, because some food service establishments have a need for both self-service type and attendant type food guard systems, a convertible type of food guard system is now available in the market that can be converted from a self-service food guard system (buffet mode) into an attendant food guard system (cafeteria mode), and vice versa. A variety of convertible food guard systems are available in the market and the manner in which they convert from one type to the other varies depending on the manufacturer. In general, the main viewing panel of a convertible food guard system is rotationally or pivotally adjustable relative to an imaginary horizontal axis that passes through the panel. In the cafeteria mode, the main viewing panel is rotational or pivotal adjusted such that the lower edge of the main viewing panel is adjacent the countertop to prevent consumer access to the food. In the buffet mode, the main viewing panel is rotational or pivotal adjusted such that the lower edge of the main viewing panel is located a particular distance away from the countertop to provide the aforementioned opening that allows consumers to access the food through the opening.

In addition to the requirement to have a main viewing panel, food guard systems are also required to have vertical side panels disposed at opposite ends of the system. The vertical side panels are required to be fixed in place such that the food is guarded from uncontrolled consumer access. Therefore, typical food guard systems on the market today commonly feature fixed side panels. In such systems, if the particular food guard system is of the aforementioned convertible type, the fixed side panels are usually inadequate to provide full side coverage in both the cafeteria mode and in the buffet mode. The reason for this is that the lower edge of the main viewing panel extends farther out in the direction of the consumer when the system is in the buffet mode than when the system is in the cafeteria mode. Consequently, in such systems, the side panels may be operable to match the lower edge of the main viewing panel when in the cafeteria mode, but may not match the lower edge of the main viewing panel when in the buffet mode. Conversely, if the convertible food guard system is designed such that the side panels meet the lower edge of the main viewing panel when the system is in the buffet mode, the side panels are awkwardly and inconveniently extended beyond the lower edge of the main viewing panel when the system is converted to the cafeteria mode.

To complicate matters of side panel designs for convertible food guard systems, recently adopted standards dictate minimum overall panel dimensions that vary for self-service style and attendant style food guard systems. Furthermore, the standards also mandate that the forward-most edge of a side panel, whether on a self-service or cafeteria style system, must be positioned such that it meets the plane defined by the leading edge of the system's main viewing panel with a minimal gap. The lower edge of the main viewing panel is the leading edge when the system is in the buffet mode whereas the front surface of the main viewing panel is the leading edge when the system is in the cafeteria mode. Notably, these newly adopted standards present significant design problems for convertible food guard systems in that there are no existing solutions that enable the forward-most edges of the side panels to coincide with the leading edge of a main viewing panel in both the cafeteria mode and in the buffet mode.

FIG. 3A is a perspective view of a known convertible food guard system 300 having an adjustable main viewing panel 315 that may be positioned such that the system is operable in either a cafeteria mode or a buffet mode. In FIG. 3A, the convertible food guard system is shown in a cafeteria mode.

As indicated above, a convertible food guard system generally provides the combined functionality of a cafeteria and buffet system in that the main viewing panel 315 can be positioned to affect either mode.

The convertible food guard system 300 has a series of fixed panels, including a top panel 305, at least one side panel 310, and an optional front panel 330, which are fixed to a support structure 320. The main viewing panel 315, however, is fixed to a hinge mechanism 325, or some other means of position adjustment, that is in turn anchored to the support structure 320. The panels, including the main viewing panel 315, operate together to define an open backed space over a food service counter, or some other surface, such that consumers may view the food through the panels without having direct access to the same, at least when the system is in cafeteria mode.

The main viewing panel 315, when the system is in the cafeteria mode, as is depicted in FIG. 3A, operates to define a plane that is substantially vertical and perpendicular to the food service counter. It should be noted that although the main viewing panel 315 is depicted as being substantially flat in structure, the main viewing panels of various types of food guard systems may be comprised of curved structures such that deformation of the panel is minimized when it is positioned in a plane that is substantially parallel to the ground.

With reference again to FIG. 3A, the leading edge 315LE of the main viewing panel 315 is positioned such that the gap between the leading edge 315LE and the food service counter is minimized, thereby prohibiting consumer access to any food residing behind and under the system. Further, the leading edge 310LE of the fixed side panel 310 is substantially aligned with the vertical plane defined by the main viewing panel 315 and front panel 330.

FIG. 3B is a perspective view of the convertible food guard system shown in FIG. 3A with the main viewing panel 315 of the system positioned in a buffet mode. In FIG. 3B, the main viewing panel 315 has been repositioned via adjustment of the hinge mechanism 325 to define a plane more closely in parallel to the plane defined by the food service countertop (not shown) on which the system 300 is mounted. In doing so, the leading edge 315LE of the main viewing panel 315 extends forward of the vertical plane previously defined by the main viewing panel 315 when in the cafeteria mode (FIG. 3A) and thereby operates to create a means by which consumers can reach under the main viewing panel 315 to access food (self-serve).

The convertible food guard system 300 depicted in FIGS. 3A and 3B is operable to be configured in either a cafeteria or buffet mode by way of positioning the hinged 325 main viewing panel 315. It is important to note, however, that the side panels 310 of the convertible food guard system 300 are fixed, either to a support structure 320 or to some other structure, such that the leading edge 310LE of the side panel does not align with the leading edge 315LE of the main viewing panel 315 when the system 300 is in buffet mode (FIG. 3B).

Accordingly, a need exists for a convertible food guard system having side panels that are capable of being positioned such that the prevailing industry standards are met regardless of the mode in which the system is being utilized.

BRIEF SUMMARY

The invention is directed to convertible food guard systems and methods. In accordance with an embodiment, the convertible food guard system comprises a support structure, at least one main viewing panel, an adjustable or hinging mechanism, at least a first adjustment mechanism component, and at least a first adjustable side panels. The support structure is configured to mechanically couple to a food service countertop. The hinge mechanism is mechanically coupled to the support structure and to the main viewing panel. The hinge mechanism is adjustable from at least a first position to at least a second position and from at least the second position to at least the first position. Adjustment of the hinge mechanism from the first position to the second position adjusts the main viewing panel from a cafeteria mode position to a buffet mode position. Adjustment of the hinge mechanism from the second position to the first position adjusts the main viewing panel from the buffet mode position to the cafeteria mode position. The first side panel is mechanically coupled to the first adjustment mechanism component in an adjustable arrangement that allows the first adjustable side panel to move relative to the support structure from a forward position to a rearward position, and vice versa. When the main viewing panel is in the cafeteria mode position, the first adjustable side panel is positionable in the rearward position such that leading edge of the first adjustable side panel is generally aligned with a leading edge of the main viewing panel. When the main viewing panel is in the buffet mode position, the first adjustable side panel is positionable in the forward position such that the leading edge of the first adjustable side panel is generally aligned with the leading edge of the main viewing panel.

The method comprises the following. With a hinge mechanism mechanically coupled to a support structure and to at least one main viewing panel, adjusting the hinge mechanism from at least a first position to at least a second position. Adjustment of the hinge mechanism from the first position to the second position adjusts the main viewing panel from a cafeteria mode position to a buffet mode position. When the main viewing panel is in the buffet mode position, a first adjustable side panel is adjustable from a rearward position to a forward position such that the leading edge of the first adjustable side panel is generally aligned with a leading edge of the main viewing panel.

These and other features and advantages of the invention will become apparent from the following description, drawings and claims.

DETAILED DESCRIPTION

Figure 1:
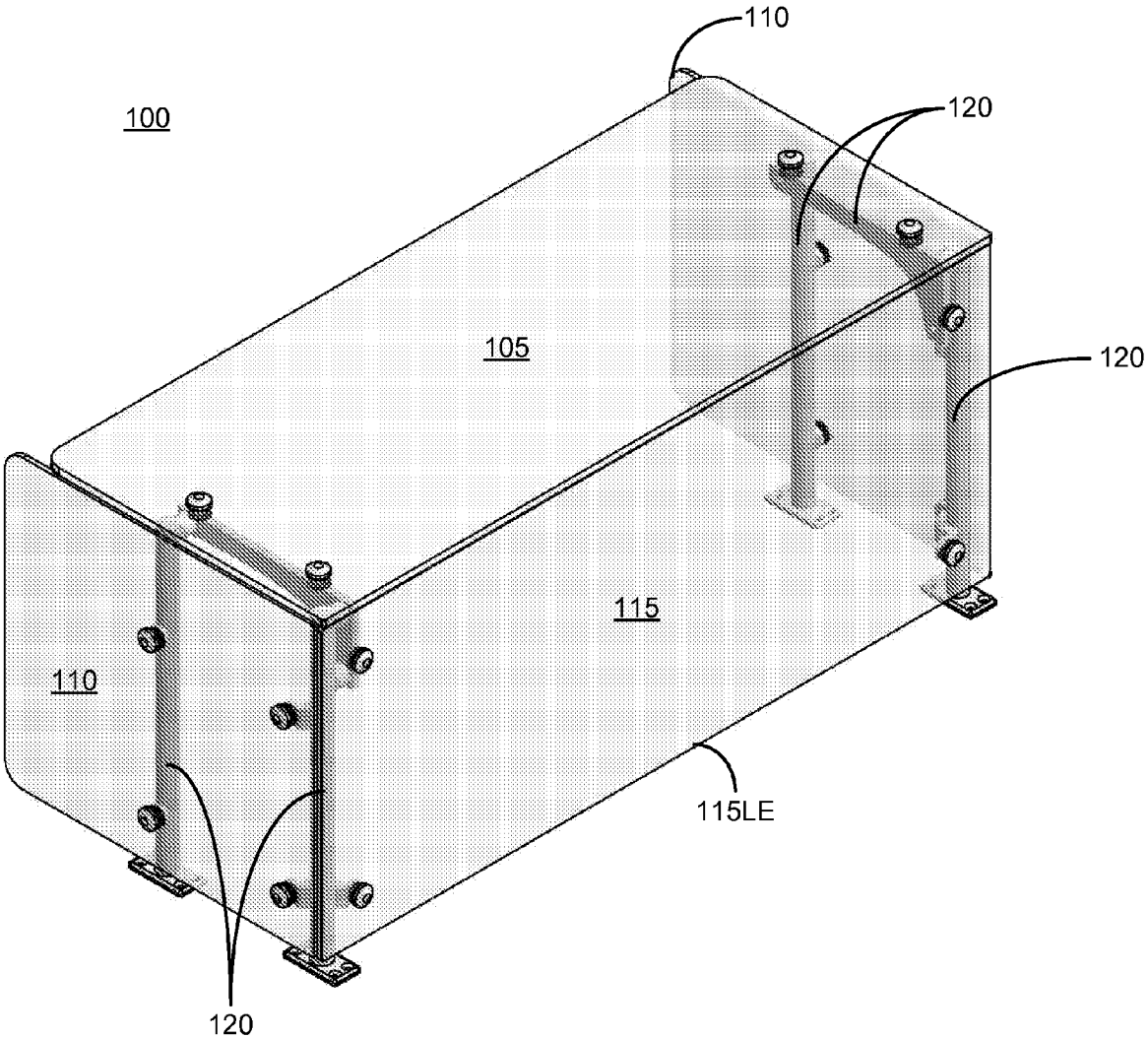
FIG. 1 is a perspective view of a typical cafeteria style, or attendant-serve, food guard system known in the art.
Figure 2:
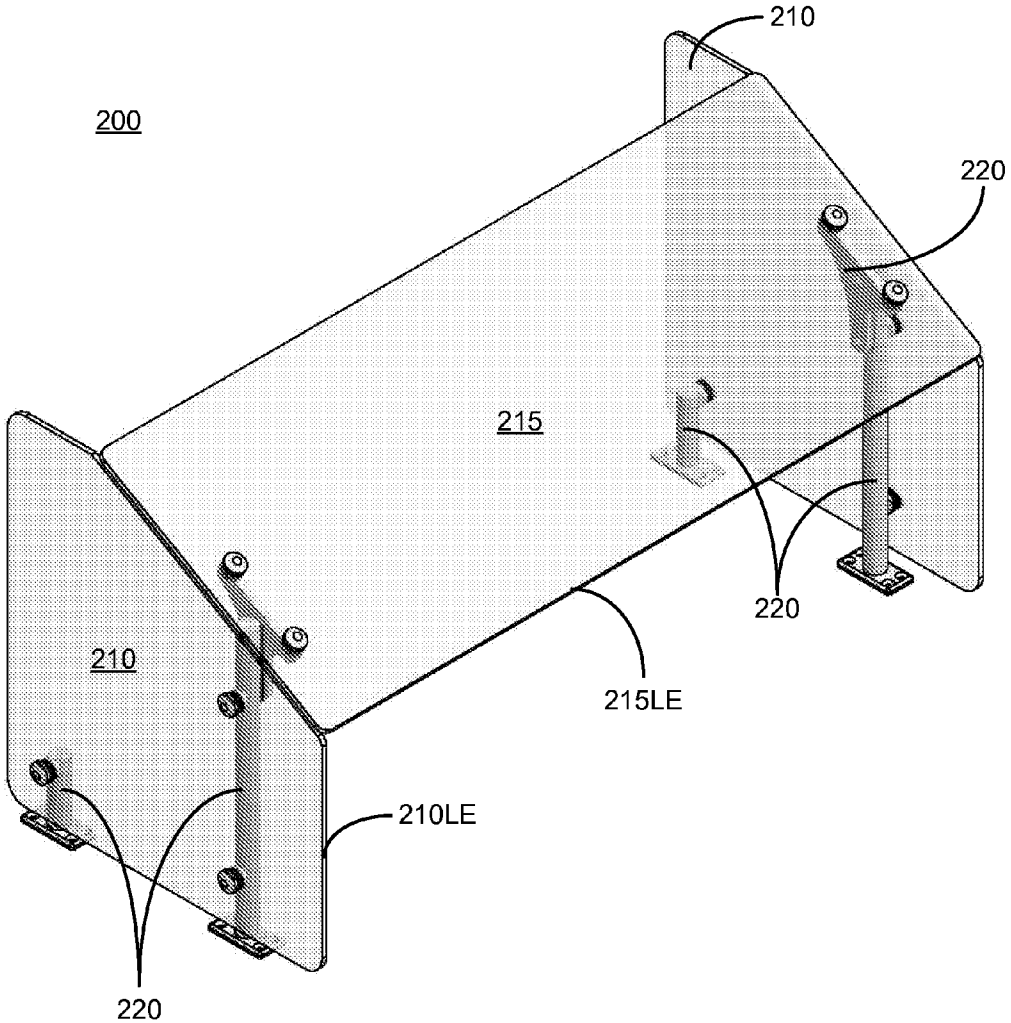
FIG. 2 is a perspective view of a typical buffet style, or self-serve, food guard system known in the art.

The presently disclosed embodiments, as well as features and aspects thereof, are directed towards a convertible food guard system with adjustable side panels. Advantageously, the convertible food guard system may be positioned in either a cafeteria mode (attendant-service) or a buffet mode (self-service) and, regardless of which of these modes the system is positioned in, provide for the leading vertical edge of the side panels to align with the foremost leading edge of a main viewing panel.

More specifically, an embodiment allows for a convertible food guard system to adjust into either a self-service (buffet) position or an attendant-service (cafeteria) position such that when adjusted into either position, the leading vertical edge of an adjustable side panel component will align with the foremost plane defined by any edge of the adjustable, or positionable (herein meaning operable to be moved from one position to another), main viewing panel. Such functionality may be accomplished, in some embodiments, by providing a second end panel, positioned parallel to a primary fixed end panel, that is operable to slide forward of the fixed panel, thereby operating in conjunction with the fixed panel to provide an uninterrupted side shield that extends to the foremost plane defined by an edge of the adjustable main viewing panel when the system is in the self-service mode. Notably, the slide mounted side panel in such an embodiment may be retracted to a parallel position behind, or in front of, the fixed panel when the system is in a cafeteria mode. Also, the fixed side panel component need not actually be fixed in some embodiments as it may be operable to slide in a plane parallel to the plane defined by the primary sliding panel. Further, it is anticipated that some embodiments may feature a plurality of side panel components, some or all of which in any given embodiment may be positionable, that together comprise the adjustable side panel feature.

In other embodiments, a single sliding vertical side panel may be employed such that the side panel may be translated forward or backward so that its leading vertical edge always aligns with the plane defined by an edge of the adjustable main viewing panel. Still other embodiments may employ a second vertical side panel that is hinged in a door-like manner to the foremost vertical edge of a fixed side panel such that when the system is in a cafeteria mode the second panel may be swung into a position that is parallel to, and overlays, the fixed panel and, when the system is in a self-service mode requiring an extended side panel, the second panel may be positioned forward of, and in the same plane as, the fixed panel. It should be understood that "hinged in a door-like manner" is used herein to generally describe any hinge mechanism operable to enable the transition of a panel from one position to another through a range of motion similar to that which a door would translate on a door-hinge when going from an "open" to a "closed" position, and such terminology is meant to include, but not be limited to, butt/mortise hinges, piano/continuous hinges, concealed hinges, butterfly hinges, strap hinges, H hinges, HL hinges, etc.

Yet other embodiments may employ a pivot hinge mechanism wherein a second side panel is hinged to a fixed side panel at either the upper or lower corner of the fixed side panel such that the second side panel may be translated, or pivoted, from one position that is parallel to, and overlays, the fixed side panel to a second position that is forward of, yet still parallel to, the fixed side panel by being rotated in a fan-like motion either 90 degrees (if the hinge point is in the lower corner of the fixed side panel) or 180 degrees (if the hinge point is in the upper corner of the fixed side panel).

Embodiments of a convertible food guard system with adjustable side panels may feature positionable side panel components that are communicable via a hinge, or some other means, to the main viewing panel itself. As has been described herein, an advantage of a convertible food guard system with adjustable side panels is the provision of a means to position the leading edge of an adjustable side panel component in alignment with the foremost edge or plane defined by a main viewing panel, regardless of food guard system mode (cafeteria or buffet). Notably, some embodiments may provide such a benefit through a side panel component that is not communicable, directly or otherwise, to a support structure of the food guard system. For example, some embodiments may, or may not, provide a fixed side panel component anchored to the food guard system support structure as well as a positionable side panel component that is hinged to the main viewing panel, preferably at the ends of the main viewing panel. Advantageously, when the main viewing panel is in a substantially vertical position (cafeteria mode), thus defining a plane perpendicular to the aforementioned fixed side panel components, a positionable hinged side panel component may be swung out of the way and either parallel to the plane of the main viewing panel or parallel to the fixed side panel. Alternatively, when the main viewing panel is translated to a position defining a more horizontal plane such that the leading edge of the main viewing panel is raised away from the food service countertop (buffet mode), the positionable hinged side panels may be swung into a vertical position that is substantially parallel to more horizontal plane defined by the main viewing panel. Advantageously, in such a configuration, an edge of the positionable hinged side panel component would align with the foremost edge of the main viewing panel.

It should be understood that, regardless of the specific mechanism used to adjust the position of a side panel component in a particular embodiment of a convertible food guard system with adjustable side panels, the positionable side panel, or panels as the case may be, in some embodiments may be operable to translate discretely between at least two positions whereas other embodiments may provide infinite adjustment of side panel positions. Importantly, while the adjustment mechanisms presently described may be encompassed in preferred embodiments of a convertible food guard system with adjustable side panels, the disclosure of the various adjustment mechanisms are offered for exemplary and enabling purposes only and, therefore, should not be construed to limit the scope of that which is taught herein.

Generally, described herein is a convertible food guard system having adjustable side panels such that the system may be converted from one mode of operation to another while maintaining the alignment of the leading edge of a side panel component with the plane defined by the foremost edge of a corresponding adjustable, or positionable, main viewing component. The adjustable side panel system may be considered a feature or module of a larger convertible food guard system or, in the alternative, may be a stand-alone system that can be retrofitted to an existing convertible food guard system. Moreover, a stand-alone adjustable side panel system may also be operable to mount to a food service counter and work in harmony with a convertible food guard system that is separately mounted to the same, or an adjacent, counter.

Turning now to the figures, where like labels represent like elements throughout the drawings, various aspects, features and embodiments of a convertible food guard system with adjustable side panels will be presented in more detail. The examples as set forth in the drawings and detailed description are provided by way of explanation and are not meant as limitations on the scope of a convertible food guard system with adjustable side panels. A convertible food guard system with adjustable side panels thus includes any modifications and variations of the following examples as come within the scope of the appended claims and their equivalents.

Figure 4A:
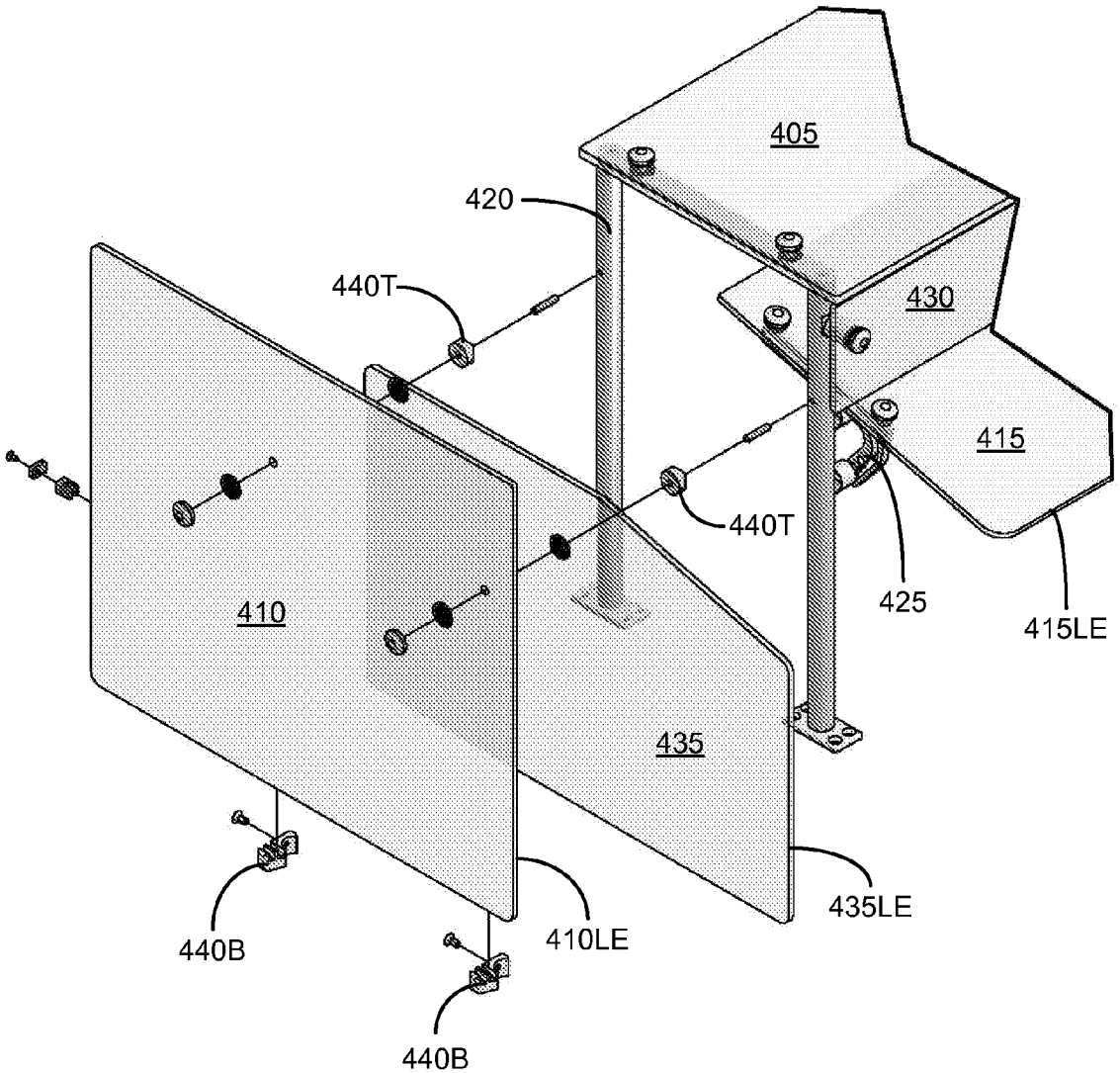
FIG. 4A is an exploded view of an end portion of an embodiment of a convertible food guard system with adjustable side panels, wherein the adjustable side panels include a fixed side panel and a sliding side panel.

FIG. 4A is an exploded perspective view of an end portion of an embodiment of a convertible food guard system having an adjustable side panel system disposed on opposite sides of the convertible food guard system. Each of the adjustable side panel systems includes a fixed side panel 410, a sliding side panel 435, and various mechanical coupling devices for mechanically coupling the fixed and sliding side panels 410, 435 to the end portion, as will be described below in further detail. The convertible food guard system having the end portion depicted in FIG. 4A has an identically configured end portion at the opposite end of the convertible food guard system, as will be described below in detail with reference to FIGS. 4B and 4C. As will be described below with reference to FIGS. 4A through 6C, the sliding side panels 435 are operable to extend or modify the side panel coverage such that a leading edges 435LE of the sliding side panels 435 may be aligned with the leading edge 415LE of a main viewing panel 415 regardless of whether the system is in a cafeteria or buffet mode.

Figure 3A:
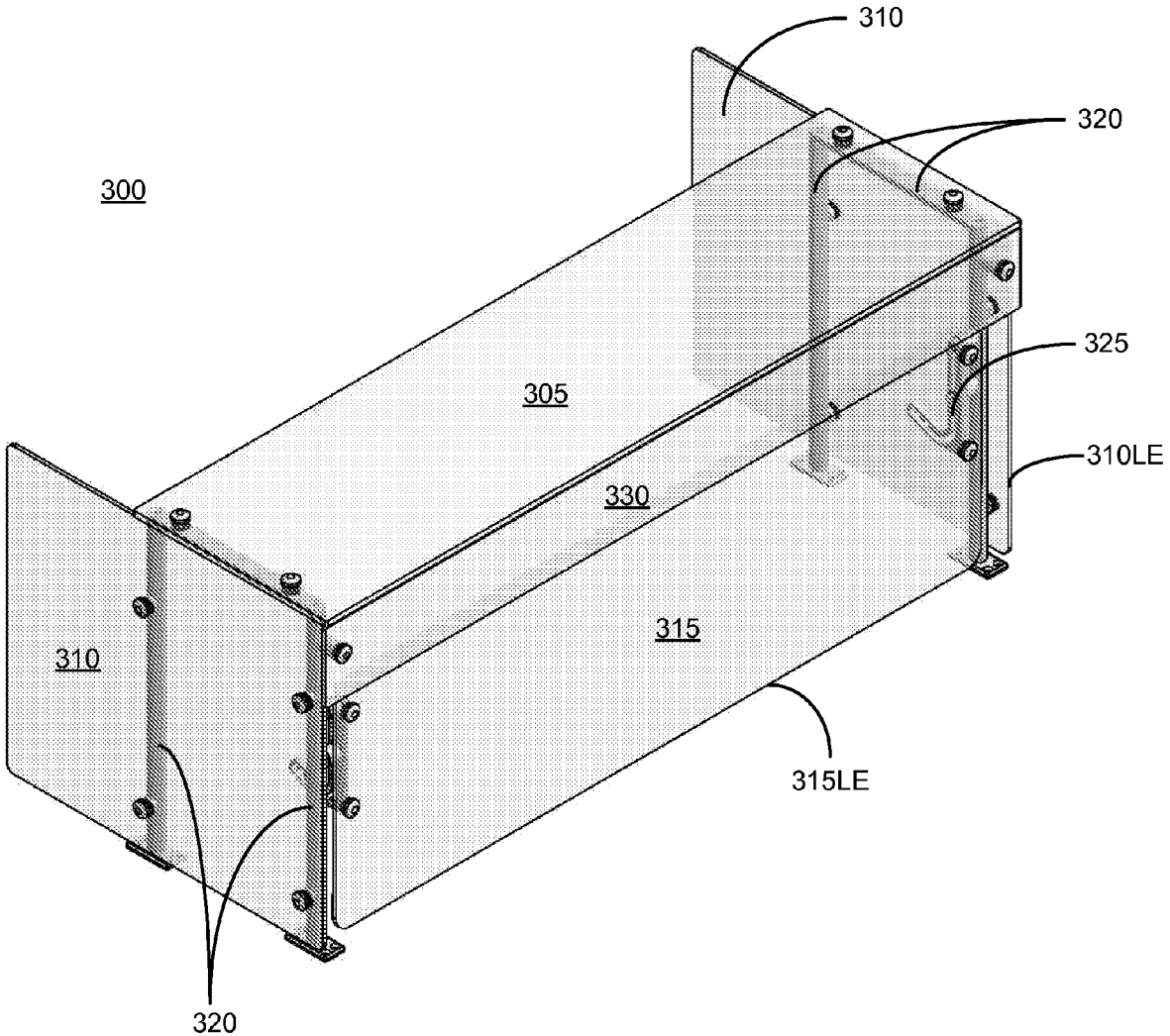
FIG. 3A is a perspective view of a typical convertible food guard system known in the art wherein the main viewing panel of the system may be positioned such that the system is operable in either a cafeteria mode or a buffet mode, depicted in the cafeteria mode.
Figure 3B:
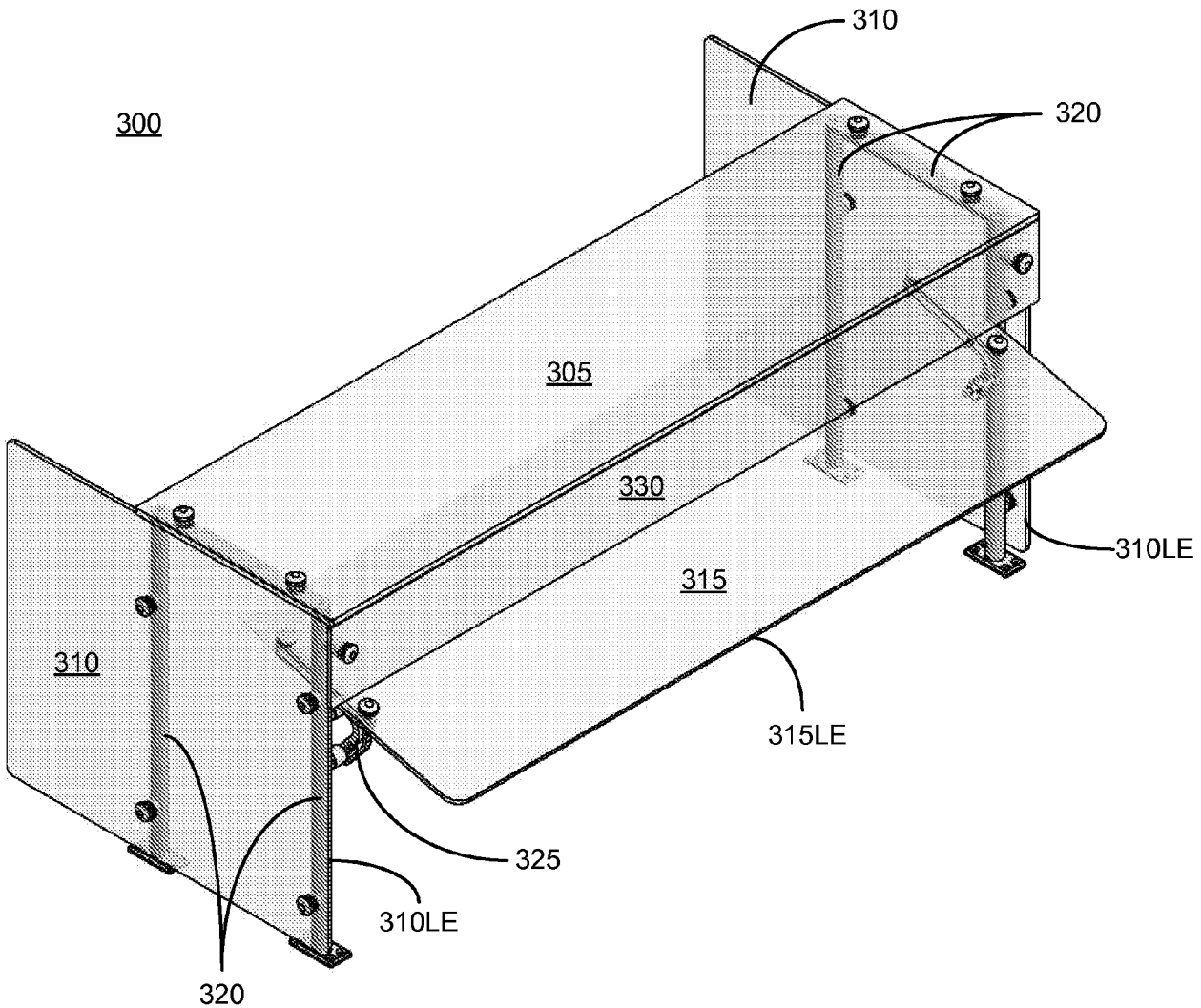
FIG. 3B is a perspective view of the convertible food guard system shown in FIG. 3A depicted in the buffet mode.

In the exploded depiction of FIG. 4A, it can be seen that the convertible food guard system has a top panel 405, a front panel 430, a support structure 420, a hinge mechanism 425 and a main viewing panel 415, which are similar to components of the food guard systems described above relative to FIGS. 3A and 3B. Additionally, the convertible food guard system depicted in FIG. 4A has a fixed side panel 410 and a sliding side panel 435 that operates in conjunction with a bottom and top slide mechanism components 440B and 440T, respectively. The top and bottom slide mechanism components 440T and 440B, are operable to be anchored to the exemplary support structure 420. When in place, the slide mechanism bottom components 440B can support both the fixed side panel 410 and the sliding side panel 435 in parallel grooves. The slide mechanism top components 440T operate to space the fixed side panel 410 from the sliding side panel 435 and to retain the sliding side panel 435 in a groove that is positioned above and substantially parallel to a corresponding groove in the slide mechanism bottom component 440B.

Advantageously, while the leading edge 410LE of the fixed side panel 410 remains in alignment with the edge of the front panel 430 and the edge of the main viewing panel 415 (when the main viewing panel 415 is in cafeteria mode), the leading edge 435LE of the sliding side panel 435 may be adjusted in position as the sliding side panel 435 can be translated forward and backward in parallel to the fixed side panel 410 via the slide mechanism top and bottom components 440B and 440T, respectively. Again, while the particular embodiment depicted features the sliding side panel 435 of the adjustable side panel system positioned on the inside of the fixed side panel 410, the sliding side panel 435 could instead be positioned on the outside of the fixed side panel 410. Further and again, while the exemplary embodiments shown depict the slide mechanism top and bottom components 440T and 440B anchored to a support structure, it is also possible that some embodiments may anchor the slide mechanism components, or other means of adjustment such as, but not limited to, a hinge, to a panel component.

Figure 4B:
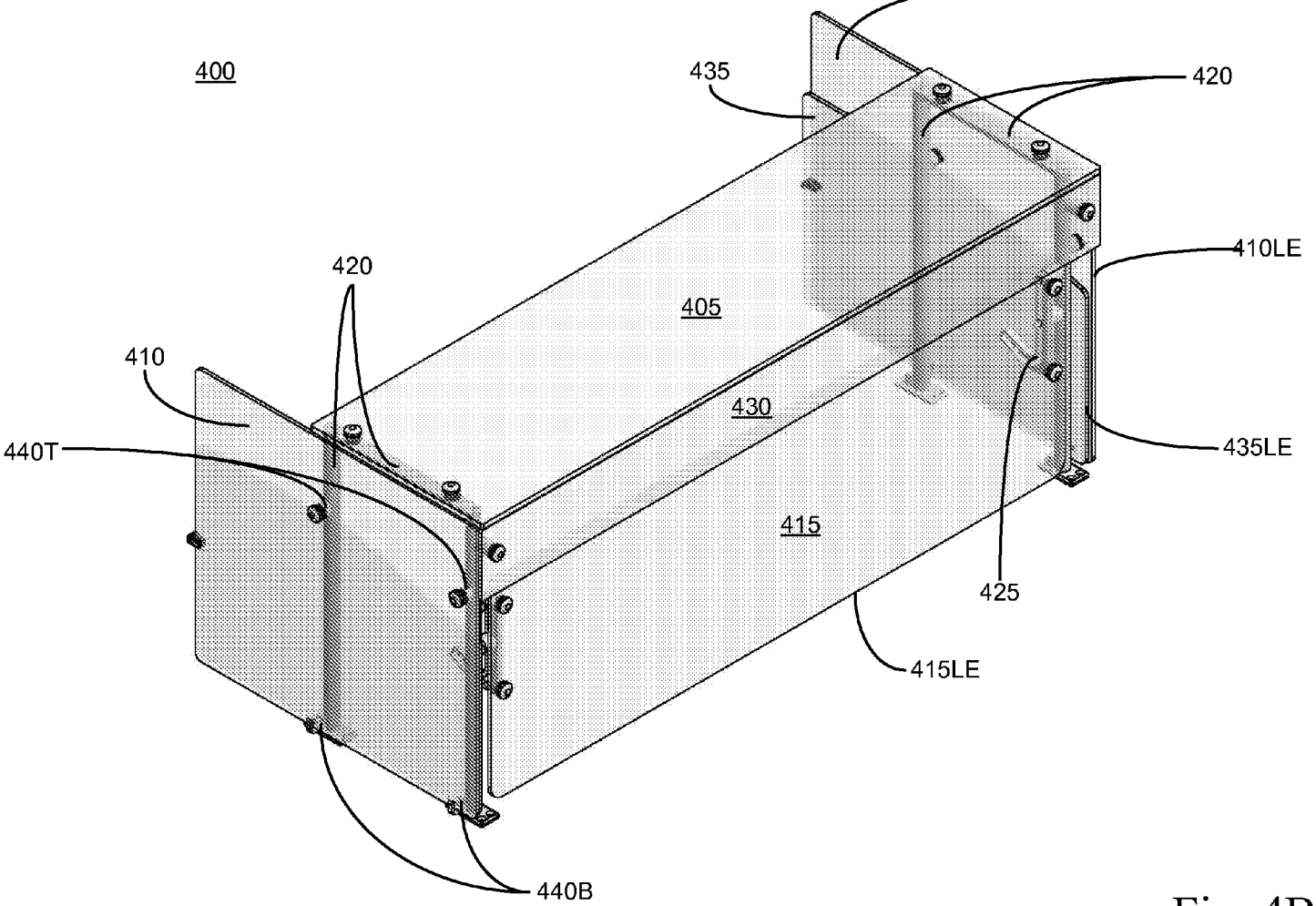
FIG. 4B is a perspective view of an embodiment of a convertible food guard system with adjustable side panels, wherein the adjustable side panels include a fixed side panel and a sliding side panel, shown in a cafeteria mode.

FIG. 4B is a perspective view of the same exemplary embodiment of a convertible food guard system 400 having the adjustable side panel system described above with reference to FIG. 4A on each end thereof. Each of the adjustable side panel systems includes a fixed side panel 410 and a sliding side panel 435. The system 400 is shown in a cafeteria mode in FIG. 4B. The exemplary embodiment is generally supported by a support structure 420 that is operable to be mounted to a surface, such as a food service counter, and to receive various components of the overall system.

Typically, panels in a food guard system comprise glass, acrylic, or some other clear, sanitary and durable material known in the art. The exemplary embodiment of a convertible food guard system 400 shown in FIG. 4B includes: a top panel 405 positioned parallel and above a food service counter, two fixed side panels 410 (alternatively, a single side panel 410 and a wall) positioned perpendicularly downward from either end of the top panel 405, a front panel 430 running lengthwise with the top panel 405 and positioned perpendicularly downward from the front edge of the top panel 405, and a main viewing panel 415 running lengthwise with the front panel 430 and extending perpendicularly downward from the lower edge of the front panel 430. All of these panels are mechanically coupled to the support structure 420 and operate to define an open-backed space over a food service counter. Notably, the main viewing panel 415 in the present embodiment is actually mechanically coupled to a hinge mechanism 425 that is, in turn, anchored to the support structure 420, similar to that which has been previously described. Also, the sliding side panels 435 are actually mechanically coupled to slide mechanisms 440B, 440T, which, in turn, are anchored to the support structure 420. Moreover, in the exemplary embodiment, the sliding side panels 435 are in a fully retracted state such that each is positioned in a plane that is behind, and parallel to, a corresponding fixed side panel 410. Further, the leading edge 435LE of each of the sliding side panels 435, while in the retracted state, does not extend beyond a vertical plane generally defined by the main viewing panel 415.

The present embodiment of a convertible food guard system 400 is described with a support structure 420 operable to receive and support various components of the overall system. It will be understood by those of ordinary skill in the art, however, that such description is offered for illustrative and enabling purposes only and, therefore, should not be construed as limiting the scope of the inventions disclosed herein. For example, some embodiments of a convertible food guard system with adjustable side panels may not require a support structure similar to that which is presently described and depicted. Some embodiments, for example, may employ a series of brackets, or some other means known in the art, to provide for rigid coupling between components of the overall system, thereby obviating the need for a support structure similar to that which is presently depicted.

Again, the embodiment of a convertible food guard system 400 with adjustable side panels 435 shown in the present figure is depicted in a cafeteria mode. More specifically, when in a cafeteria (attendant-served) mode, the main view panel 415 is positioned substantially in a vertical position such that any gap between the leading edge 415LE of the main viewing panel 415 and the food service counter is minimized. In such an arrangement, food is generally being served by an attendant located behind the convertible food guard system 400 by passing food to a consumer over the top panel 405. The consumer can view the food residing behind and beneath the system through the main viewing panel 415, but is prevented by the panels from accessing the food directly. Notably, when in a cafeteria mode, the convertible food guard system 400 with adjustable side panels provides a means by which the sliding side panels 435 reside in a retracted state such that the leading edges 435LE of the sliding side panels 435 do not extend beyond a vertical plane substantially defined by the main viewing panel 415 and top panel 430.

Figure 4C:
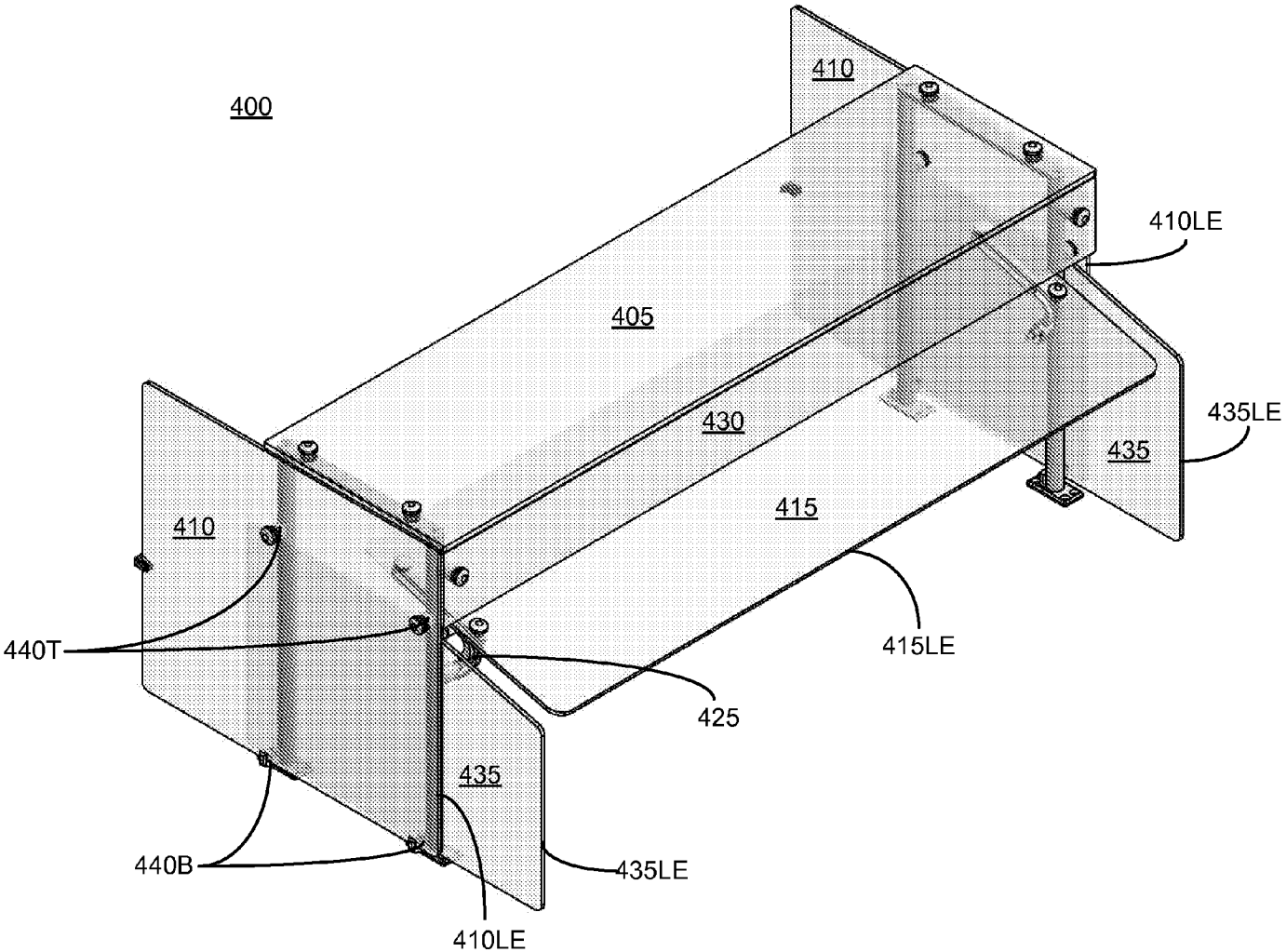
FIG. 4C is a perspective view of an embodiment of a convertible food guard system with adjustable side panels, wherein the adjustable side panels include a fixed side panel and a sliding side panel, shown in a buffet mode.

FIG. 4C is a perspective view of the same exemplary embodiment of a convertible food guard system 400 shown in FIG. 4B after the system 400 has been placed in the buffet mode. As previously described, the adjustable side panel system of the convertible food guard system 400 includes a fixed side panel 410 and a sliding side panel 435. When in the buffet mode, the convertible food guard system 400 provides a means by which consumers can readily access food residing beneath the system on a self-serve basis as typically no attendant is present behind the system.

In the depicted buffet mode, the main viewing panel 415 is pivoted, or rotated, upward, relative to the food service countertop (not shown), via the hinge mechanism 425. In such an upwardly pivoted position, the main viewing panel 415 no longer defines a substantially vertical plane and its leading edge 415LE extends forward of the vertical plane defined by the forward most edge of the top panel 405 and surface of the front panel 430. Advantageously, the sliding side panels 435 can be extended forward, remaining in parallel to the respective fixed side panels 410, such that the overall surface defined by the adjustable side panel system is increased and the leading edges 435LE of the sliding side panels 435 are substantially aligned with the leading edge 415LE of the main viewing panel 415.

To reiterate, an advantage of a convertible food guard system with adjustable side panels, such as the exemplary embodiment illustrated in FIGS. 4A through 4C, is that it can be readily converted from a cafeteria mode to a buffet mode, and vice versa. As described above, while convertible food guard systems operable to alternate between cafeteria and buffet modes are known in the art, the known convertible food guard systems do not meet the requirements of the applicable standards when in the buffet mode and when in the cafeteria mode. One of the advantageous features of the embodiments of the convertible food guard system disclosed herein is that the side panels 435 are easily adjustable via the top and bottom slide mechanism components 440T and 440B, respectively, to enable the requirements of the applicable standards to be met at all times regardless of whether the food guard system is positioned in the buffet mode or in the cafeteria mode. The adjustability of the sliding side panels 435 enables a user to position the sliding side panels 435 such that the leading edges of the sliding side panels 435 align with the foremost, or leading, edge 415LE of the main viewing panel 415 when it is in a non-vertical position, thus fulfilling requirements of promulgated industry regulations for buffet style food guard systems. Advantageously, when the mode is adjusted such that the main viewing panel 415 is in a substantially vertical position, i.e. cafeteria mode, the sliding side panels 435 can be retracted so as not to interfere with consumers.

Figure 5A:
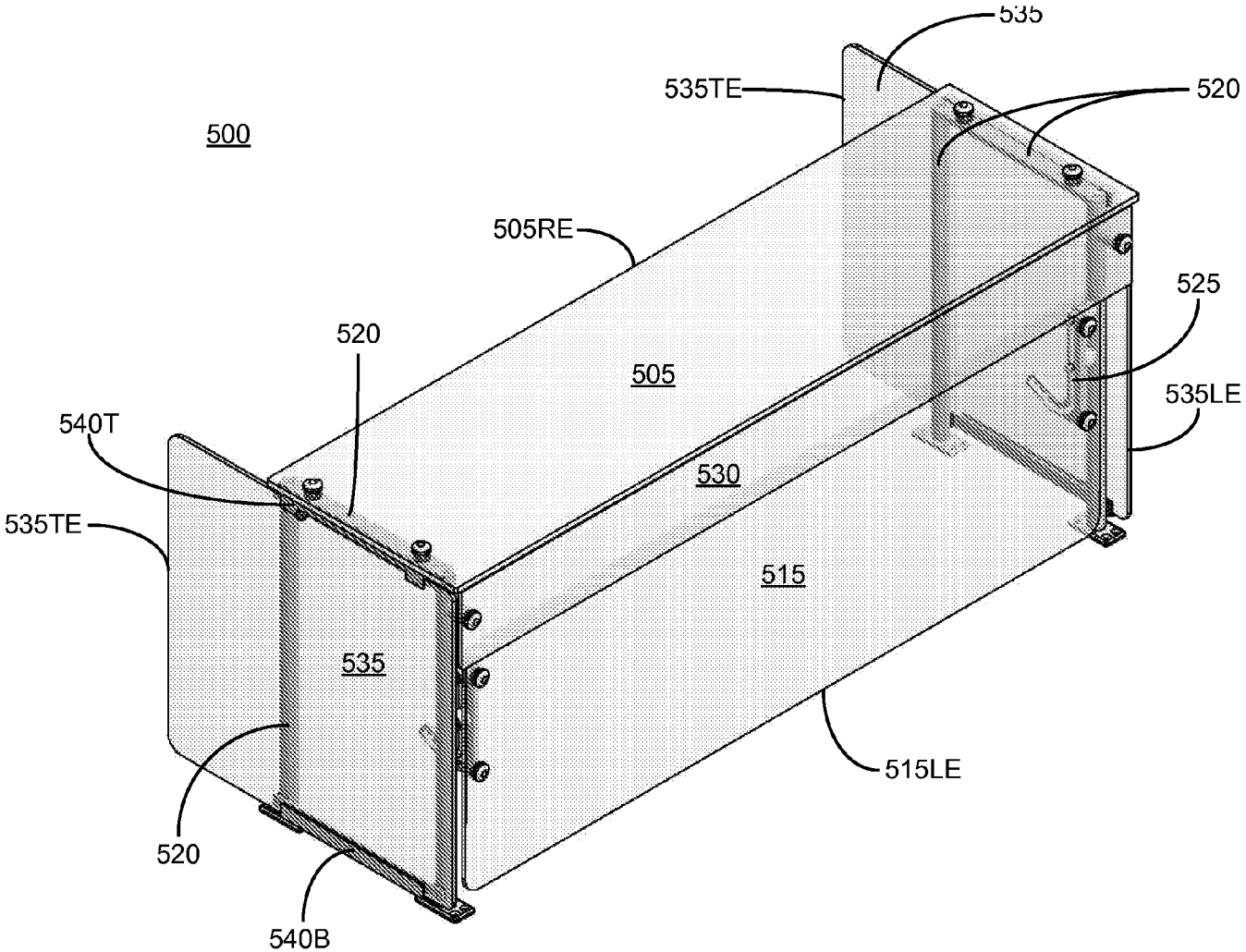
FIG. 5A is a perspective view of an embodiment of a convertible food guard system with adjustable side panels, wherein the adjustable side panel includes a single sliding side panel, shown in a cafeteria mode.

FIG. 5A is a perspective view of an embodiment of a convertible food guard system 500 shown in a cafeteria mode. Similar to the exemplary embodiment of a convertible food guard system 400 shown in FIG. 4B, the convertible food guard system 500 shown in FIG. 5A includes: a top panel 505 positioned parallel and above a food service counter, two sliding side panels 535 (alternatively, a single side panel 535 and a wall) positioned perpendicularly downward from either end of the top panel 505, a front panel 530 running lengthwise with the top panel 505 and positioned perpendicularly downward from the front edge of the top panel 505, and a main viewing panel 515 running lengthwise with the front panel 530 and extending perpendicularly downward from the lower edge of the front panel 530. All of these panels are mechanically coupled to the support structure 520 and operate to define an open-backed space over a food service counter. Notably, the main viewing panel 515 in the present embodiment is actually coupled to a hinge mechanism 525 that is, in turn, anchored to the support structure 520, similar to that which has been previously described. Also, the sliding side panels 535 are actually coupled to bottom and top slide mechanism components 540B, 540T that are, in turn, anchored to the support structure 520. Moreover, in the exemplary embodiment, the sliding side panels 535 are in a fully retracted state but, unlike the exemplary embodiment described and depicted in FIGS. 4A and 4B, do not combine with a fixed side panel component to make up the adjustable side panel system.

In the present exemplary embodiment of the convertible food guard system 500, the sliding side panel 535 is supported in a sliding mechanism having a bottom channel component 540B and a top channel component 540T. As such, the sliding side panel 535 is necessarily larger than the sliding side panels previously described as it must be operable to extend forward in the sliding mechanism components 540B, 540T and align its leading edge 535LE with the leading edge 515LE of the main viewing panel 515 without exposing any food through an open side of the convertible food guard system. Notably, the leading edge 535LE of each of the sliding side panels 535, while in the retracted state (i.e., cafeteria mode), does not extend beyond a plane generally defined by the main viewing panel 515. While in the retracted state, however, trailing edges 535TE of the sliding side panels 535 extend back beyond the rear edge 505RE of the top panel 505.

Figure 5B:
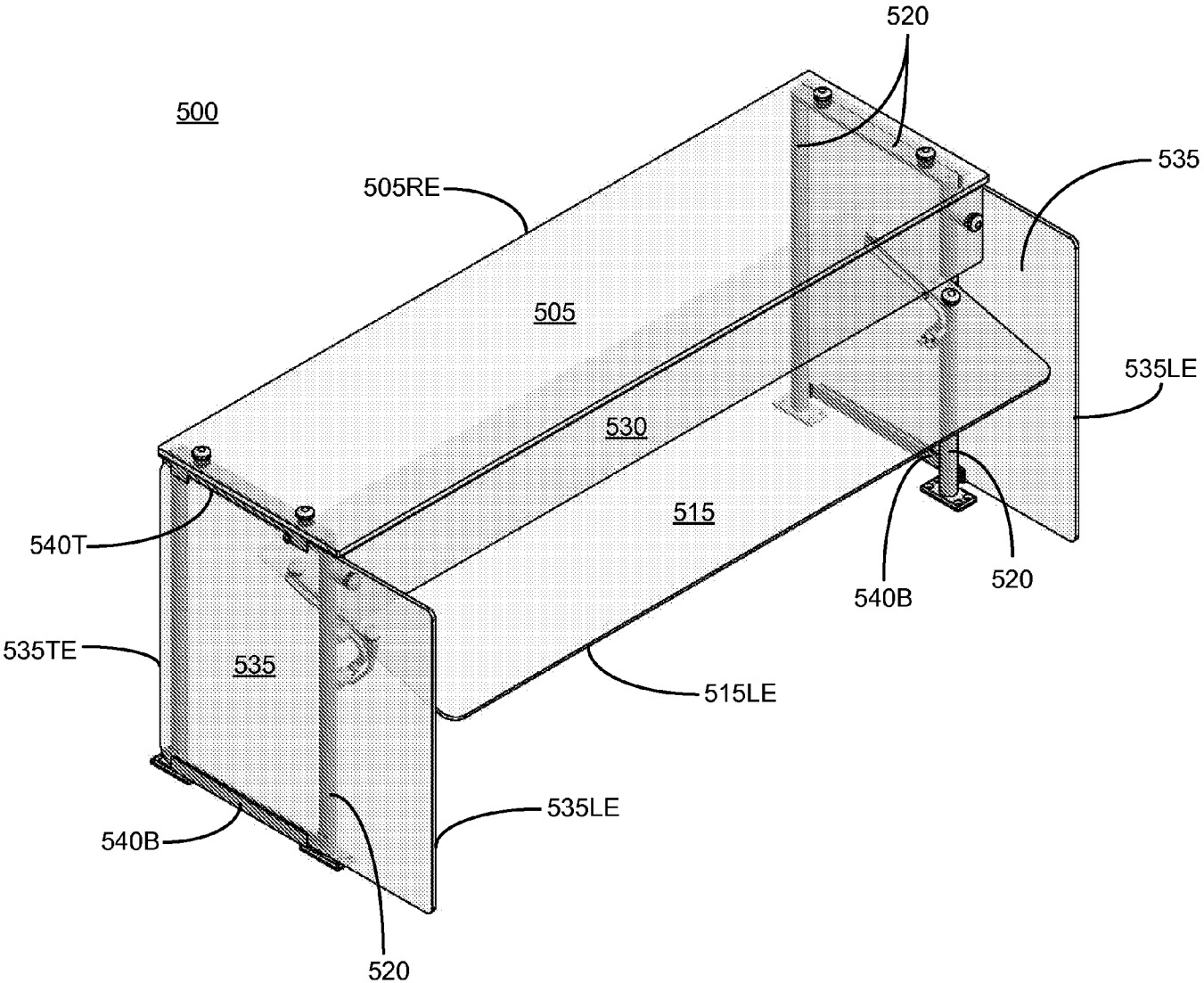
FIG. 5B is a perspective view of a convertible food guard system with adjustable side panels, wherein the adjustable side panel includes a single sliding side panel, shown in a buffet mode.

FIG. 5B is a perspective view of the convertible food guard system 500 shown in FIG. 5A positioned in the buffet mode. It should be noted that the sliding side panels 535 operate to provide substantially the same protection as the adjustable panel systems that include the fixed panels 410 described above with reference to FIGS. 4A and 4B. The difference, however, is that the sliding side panels 535 operate to simultaneously cover the side of the system while extending a leading edge 535LE to substantially align with the leading edge 515LE of the main viewing panel 515 when it is positioned in the buffet mode.

Figure 5C:
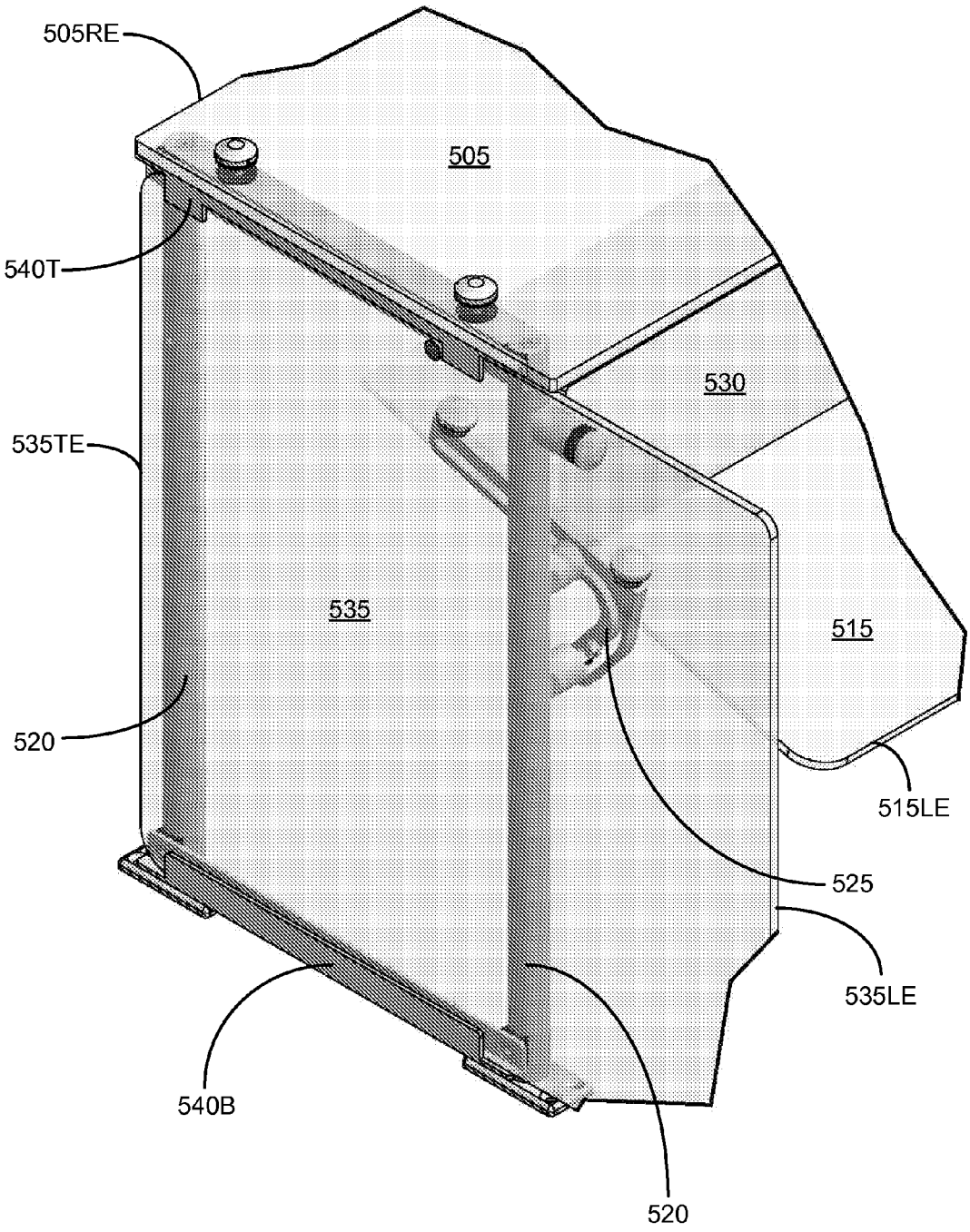
FIG. 5C is a close-up, perspective view of an end portion of a convertible food guard system with adjustable side panels wherein the adjustable side panel includes a single sliding side panel, shown in a buffet mode.

FIG. 5C is a close-up, perspective view of an end portion of the convertible food guard system 500 shown in FIGS. 5A and 5B when the system 500 is positioned in the buffet mode. FIG. 5C provides a closer view of the sliding mechanism, which comprises an upper channel component 540T and a lower channel component 540B. As already described, the sliding side panel 535 is operable to translate forward and backward by sliding within the sliding mechanism 540B, 540T. The particular sliding mechanism shown is offered for exemplary purposes and should not be interpreted to limit the scope of a convertible food guard system 500. Persons of ordinary skill in the art will understand that a variety of mechanisms may be used to provide the translating motion needed for the sliding side panels 535.

Figure 6A:
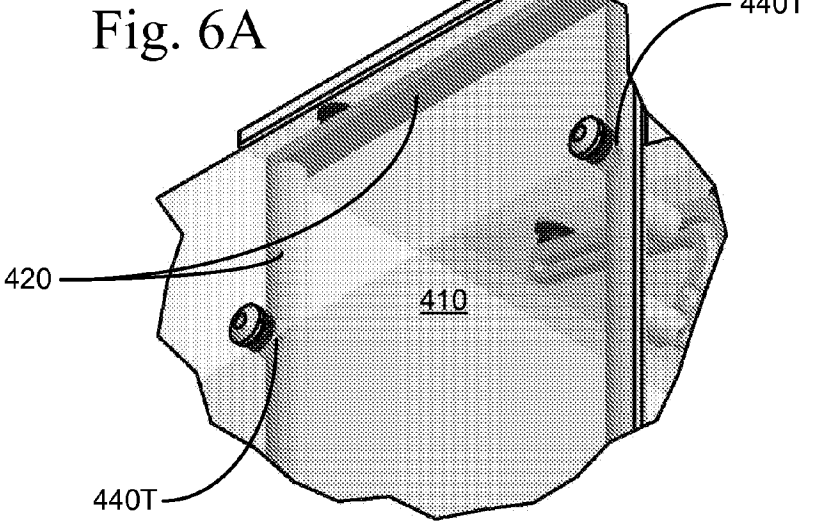
FIG. 6A-C depict close-up views an exemplary slide mechanism comprised in some embodiments of an adjustable side panel system that incorporates a plurality of panels.
Figure 6B:
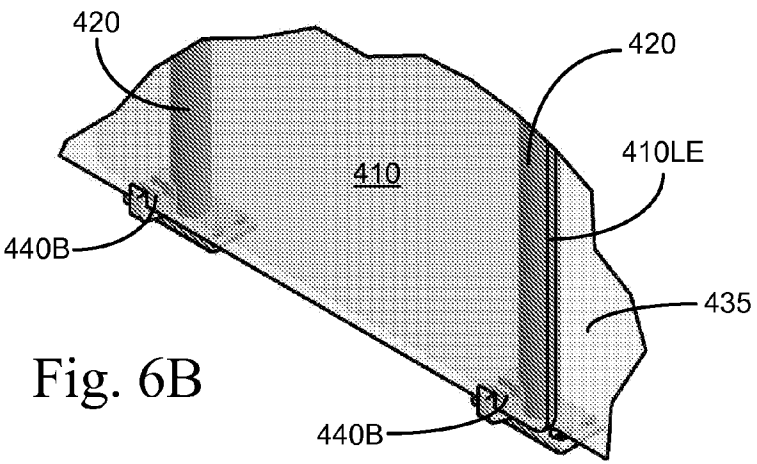
Figure 6C:
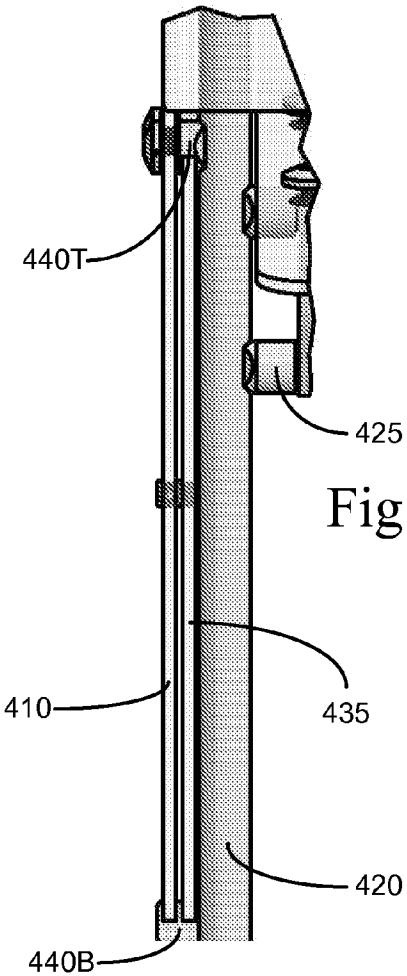

FIGS. 6A-C depict close-up views of the top and bottom slide mechanism components 440T and 440B used in the convertible food guard system 400 described above with reference to FIGS. 4A-4C. Because these components have been described above with reference to FIGS. 4A-4C, no further description will be provided herein.

It should be noted that although the embodiments of the convertible food guard system described above refer to the support structure of the food guard system being attached to a countertop, this is not necessarily the case. For example, the support structure of the convertible food guard system may instead be suspended about the countertop from the ceiling of the establishment or from some other structure disposed above the countertop. Also, while the embodiments described above refer to the convertible food guard system having an adjustable side panel on each end thereof, a single adjustable side panel may be all that is needed in certain cases, such as, for example, in cases in which one end of the convertible food guard system is positioned adjacent to, or in abutment with, a wall or other structure.

The present convertible food guard system with adjustable side panels has been described using detailed descriptions of embodiments thereof that are provided by way of example and are not intended to limit the scope of the system. The described embodiments comprise different features, not all of which are required in all embodiments of a convertible food guard system with adjustable side panels. Some embodiments of a convertible food guard system with adjustable side panels utilize only some of the features or possible combinations of the features. Variations of embodiments of a convertible food guard system with adjustable side panels that are described and embodiments of a convertible food guard system with adjustable side panels comprising different combinations of features noted in the described embodiments will occur to persons of the art.

Moreover, it will be appreciated by persons skilled in the art that a convertible food guard system with adjustable side panels is not limited by what has been particularly shown and described herein above. Rather, the scope of a convertible food guard system with adjustable side panels is defined by the claims that follow.

What is claimed is:

1. A convertible food guard system comprising:

a support structure configured to mechanically couple to a food service countertop;

at least one main viewing panel;

an adjustable mechanism mechanically coupled to the support structure and to the at least one main viewing panel, wherein the adjustable mechanism is adjustable from at least a first position to at least a second position and from the at least a second position to the at least a first position, and wherein adjustment of the adjustable mechanism from the first position to the second position adjusts the main viewing panel from a cafeteria mode position to a buffet mode position, and wherein adjustment of the adjustable mechanism from the second position to the first position adjusts the main viewing panel from the buffet mode position to the cafeteria mode position;

at least a first adjustment mechanism component mechanically coupled to the support structure on a first side of the support structure; and at least a first adjustable side panel mechanically coupled to the first adjustment mechanism component in an adjustable arrangement that allows the first adjustable side panel to move substantially horizontally relative to the support structure from a forward position to a rearward position, and vice versa, wherein when the main viewing panel is in the cafeteria mode position, the first adjustable side panel is positionable in the rearward position such that a leading edge of the first adjustable side panel is generally aligned with a leading edge of the main viewing panel, and wherein when the main viewing panel is in the buffet mode position, the first adjustable side panel is positionable in the forward position such that the leading edge of the first adjustable side panel is generally aligned with the leading edge of the main viewing panel, and wherein if the support structure is mechanically coupled to the food service countertop, a certain gap distance between the first adjustable side panel and the food service countertop is substantially maintained when the first adjustable side panel is positioned at the forward and rearward positions.

2. The system of claim 1, further comprising:

at least a second adjustment mechanism component mechanically coupled to the support structure on a second side of the support structure opposite the first side of the support structure; and at least a second adjustable side panel mechanically coupled to the second adjustment mechanism component in an adjustable arrangement that allows the second adjustable side panel to move substantially horizontally relative to the support structure from a forward position to a rearward position, and vice versa, wherein when the main viewing panel is in the cafeteria mode position, the second adjustable side panel is positionable in the rearward position such that the leading edge of the second adjustable panel is generally aligned with the leading edge of the main viewing panel, and wherein when the main viewing panel is in the buffet mode position, the second adjustable side panel is positionable in the forward position such that the leading edge of the second adjustable side panel is generally aligned with the leading edge of the main viewing panel, and wherein if the support structure is mechanically coupled to the food service countertop, the first and second adjustable side panels are generally parallel to one another and certain gap distances between each adjustable side panel and the food service countertop are substantially maintained when the adjustable side panels are positioned at the forward and rearward positions.

3. The system of claim 2, wherein the first and second adjustment mechanism components are first and second slide mechanism components, respectively, and wherein the first and second adjustable side panels are first and second sliding side panels, respectively, that slide in the forward and rearward directions relative to the support structure to the forward and rearward positions.

4. The system of claim 3, wherein the first and second slide mechanism components include rollers.

5. The system of claim 2, further comprising:

at least first and second fixed side panels mechanically coupled to the support structure adjacent and generally parallel to the first and second adjustable side panels, respectively, and wherein the first and second fixed side panels have respective leading edges that are generally aligned with the leading edge of the main viewing panel when the main viewing panel is positioned in the cafeteria mode position.

6. The system of claim 1, wherein said adjustable mechanism may be adjusted to, and fixed in, a plurality of positions defined within a range between the first position and the second position.

7. The system of claim 1, further comprising a top panel mechanically coupled to the support structure, wherein the top panel defines a horizontal plane that is generally parallel to the food service counter to which the support structure is configured to mechanically couple.

8. A convertible food guard system comprising:

a support structure configured to mechanically couple to a food service countertop;

a top panel mechanically coupled to the support structure such that if the support structure is mechanically coupled to the food service countertop, the top panel defines a plane that is generally parallel to a plane defined by the countertop;

at least one main viewing panel;

a hinge mechanism mechanically coupled to the support structure and to the at least one main viewing panel, wherein the hinge mechanism is adjustable from at least a first position to at least a second position and from the at least a second position to the at least a first position, and wherein adjustment of the hinge mechanism from the first position to the second position adjusts the main viewing panel from a cafeteria mode position to a buffet mode position, and wherein adjustment of the hinge mechanism from the second position to the first position adjusts the main viewing panel from the buffet mode position to the cafeteria mode position;

at least first and second slide mechanism components mechanically coupled to the support structure on opposite sides of the support structure; and at least first and second sliding side panels mechanically coupled to the first and second slide mechanism components in sliding arrangements that allow the first and second sliding side panels to slide substantially horizontally relative to the support structure from a forward position to a rearward position, and vice versa, wherein when the main viewing panel is in the cafeteria mode position, each of the sliding side panels is positionable in the rearward position such that respective leading edges of the respective sliding panels are generally aligned with a leading edge of the main viewing panel, and wherein when the main viewing panel is in the buffet mode position, each of the sliding side panels is positionable in the forward position such that the respective leading edges of the respective sliding side panels are generally aligned with the leading edge of the main viewing panel, and wherein the first and second sliding side panels are generally parallel to one another and generally perpendicular to the top panel.

9. The system of claim 8, wherein the hinge mechanism may be adjusted to, and fixed in, a plurality of positions defined within a range between the first position and the second position.

10. The system of claim 8, further comprising:

at least first and second fixed side panels mechanically coupled to the support structure adjacent and generally parallel to the first and second sliding side panels, respectively, and wherein the first and second fixed side panels have respective leading edges that are generally aligned with the leading edge of the main viewing panel when the main viewing panel is positioned in the cafeteria mode position.

11. The system of claim 10, wherein the first and second slide mechanism components include rollers.

12. A convertible food guard system comprising:

a support structure configured to be suspended above a food service countertop;

at least one main viewing panel;

a hinge mechanism mechanically coupled to the support structure and to the at least one main viewing panel, wherein the hinge mechanism is adjustable from at least a first position to at least a second position and from the at least a second position to the at least a first position, and wherein adjustment of the hinge mechanism from the first position to the second position adjusts the main viewing panel from a cafeteria mode position to a buffet mode position, and wherein adjustment of the hinge mechanism from the second position to the first position adjusts the main viewing panel from the buffet mode position to the cafeteria mode position;

at least a first adjustment mechanism component mechanically coupled to the support structure on a first side of the support structure; and at least a first adjustable side panel mechanically coupled to the first adjustment mechanism component in an adjustable arrangement that allows the first adjustable side panel to move substantially horizontally relative to the support structure from a forward position to a rearward position, and vice versa, wherein when the main viewing panel is in the cafeteria mode position, the first adjustable side panel is positionable in the rearward position such that a leading edge of the first adjustable side panel is generally aligned with a leading edge of the main viewing panel, and wherein when the main viewing panel is in the buffet mode position, the first adjustable side panel is positionable in the forward position such that the leading edge of the first adjustable side panel is generally aligned with the leading edge of the main viewing panel, and wherein if the support structure is suspended above the food service countertop, a certain gap distance between the first adjustable side panel and the food service countertop is substantially maintained when the adjustable side panel is positioned at the forward and rearward positions.

13. The system of claim 12, further comprising:

at least a second adjustment mechanism component mechanically coupled to the support structure on a second side of the support structure opposite the first side of the support structure; and at least a second adjustable side panel mechanically coupled to the second adjustment mechanism component in an adjustable arrangement that allows the second adjustable side panel to move substantially horizontally relative to the support structure from a forward position to a rearward position, and vice versa, wherein when the main viewing panel is in the cafeteria mode position, the second adjustable side panel is positionable in the rearward position such that the leading edge of the second adjustable panel is generally aligned with the leading edge of the main viewing panel, and wherein when the main viewing panel is in the buffet mode position, the second adjustable side panel is positionable in the forward position such that the leading edge of the second adjustable side panel is generally aligned with the leading edge of the main viewing panel, and wherein if the support structure is suspended above the food service countertop, the first and second adjustable side panels are generally parallel to one another and certain gap distances between each adjustable side panel and the food service countertop are substantially maintained when the adjustable side panels are positioned at the forward and rearward positions.

14. The system of claim 13, wherein the first and second adjustment mechanism components are first and second slide mechanism components, respectively, and wherein the first and second adjustable side panels are first and second sliding side panels, respectively, that slide in the forward and rearward directions relative to the support structure to the forward and rearward positions.

* * * * *